US011286534B2

(12) United States Patent
Sievers et al.

(10) Patent No.: US 11,286,534 B2
(45) Date of Patent: Mar. 29, 2022

(54) STEEL ALLOY AND METHOD FOR HEAT TREATING STEEL ALLOY COMPONENTS

(71) Applicant: The Boeing Company, Chicago, IL (US)

(72) Inventors: Daniel E. Sievers, Owens Cross Roads, AL (US); Peter J. Bocchini, Huntsville, AL (US)

(73) Assignee: The Boeing Company, Chicago, IL (US)

( * ) Notice: Subject to any disclaimer, the term of this patent is extended or adjusted under 35 U.S.C. 154(b) by 215 days.

(21) Appl. No.: 16/512,665

(22) Filed: Jul. 16, 2019

(65) Prior Publication Data

US 2020/0024680 A1 Jan. 23, 2020

Related U.S. Application Data

(60) Provisional application No. 62/699,840, filed on Jul. 18, 2018.

(51) Int. Cl.

| | |
|---|---|
| ***C21D 6/00*** | (2006.01) |
| ***C22C 38/14*** | (2006.01) |
| ***C22C 38/12*** | (2006.01) |
| ***C22C 38/10*** | (2006.01) |
| ***C22C 38/06*** | (2006.01) |

(52) U.S. Cl.

CPC ..... *C21D 6/007* (2013.01); *C21D 6/001* (2013.01); *C22C 38/06* (2013.01); *C22C 38/105* (2013.01); *C22C 38/12* (2013.01); *C22C 38/14* (2013.01)

(58) Field of Classification Search

CPC ..... C21D 6/001; C21D 6/007; C21D 6/02; C21D 7/13; C21D 8/005; C22C 33/0285; C22C 38/002; C22C 38/004; C22C 38/06; C22C 38/08; C22C 38/105; C22C 38/12; C22C 38/14; C22C 38/32; C22C 38/44; C22C 38/52

See application file for complete search history.

(56) References Cited

U.S. PATENT DOCUMENTS

| | | | |
|---|---|---|---|
| 3,093,519 | A | 6/1963 | Decker et al. |
| 3,262,777 | A | 7/1966 | Sadowski |
| 3,262,823 | A | 7/1966 | Sadowski |

(Continued)

FOREIGN PATENT DOCUMENTS

| | | | | |
|---|---|---|---|---|
| AU | 2011 236 054 | | 10/2011 | |
| EP | 256619 | A * | 2/1988 | ..... B23D 61/185 |

(Continued)

OTHER PUBLICATIONS

Effect of Nb on the recrystallization of austenite containing high dislocation Density Setsuo Takaki International Symposium on Niobium microalloyed sheet steel for automotive application pp. 565-573 (Year: 2006).*

(Continued)

*Primary Examiner* — Jenny R Wu

(74) *Attorney, Agent, or Firm* — Walters & Wasylyna LLC

(57) ABSTRACT

A steel alloy including, by weight percent: Ni: 18 to 19%; Co: 11.5 to 12.5%; Mo: 4.6 to 5.2%; Ti: 1.3 to 1.6%; Al: 0.05 to 0.15%; Nb: 0.15 to 0.30%; B: 0.003 to 0.020%; Cr: max 0.25%; Mn: max 0.1%; Si: max 0.1%; C: max 0.03%; P: max 0.005%; and S: max 0.002%, the balance being iron plus incidental impurities.

23 Claims, 8 Drawing Sheets

(56) References Cited

U.S. PATENT DOCUMENTS

| | | | |
|---|---|---|---|
| 3,313,662 | A | 4/1967 | Malagari et al. |
| 4,832,909 | A | 5/1989 | Schmidt et al. |
| 7,776,255 | B1 | 8/2010 | Wedding et al. |

FOREIGN PATENT DOCUMENTS

| | | | | |
|---|---|---|---|---|
| JP | S4830624 | A | * | 4/1973 |
| JP | S6115917 | A | * | 1/1986 |

OTHER PUBLICATIONS 18 per cent nickel maraging steels Engineering properties Nickel Development Institute, (Year: 1976).*

Maraging steel Wikipedia (Year: 2017).*

International Searching Authority: International Search Report and Written Opinion, App. No. PCT/US2019/041937 (dated Oct. 7, 2019).

Charles Carson: "Heat Treating Maraging Steels," ASM Handbook, Heat Treating of Iron and Steels, vol. 4D (2014).

Information & Data Management | IS | SGG, "*Niobium an Boron doping of High Strength Steels*", Project 11210, (Feb. 1, 2018), pp. 1-136.

Niobium Products Company GmbH, "*The Role of Niobium in Low Carbon Bainitic HSLA Steel*", pp. 1-12.

The Minerals, Metals & Materials Society and ASM International 2013, "*Effect of Boron Addition and Initial Heat-Treatment Temperature on Microstructure and Mechanical Properties of Modified 9Cr-1Mo Steels Under Different Heat-Treatment Conditions*", Pager 2171-2186.

J. Mater. Sci Technol., "*Evaluation of Mechanical Properties According to Nb Content of High Strength Steel Manufactured in VIM*", vol. 24 No. 5, 2008, pp. 793-796.

Metalurgua 49 (2010), "*Centreline Formation of Nb*(C, N) *Eutectic in Structural Steel*", (Feb. 20, 2009), pp. 29-32.

Journal of Materials Processing Technology 162-163 (2005), "The Influence of Niobium and Aging Treatment in the 18% Ni Maraging Steel", pp. 342-349.

* cited by examiner

STEEL ALLOY AND METHOD FOR HEAT TREATING STEEL ALLOY COMPONENTS

PRIORITY

This application claims priority from U.S. Ser. No. 62/699,840 filed on Jul. 18, 2018.

FIELD

This application relates to steel alloys and, more particularly, to steel alloys suitable for critical aircraft engine components requiring high tensile strength, high fracture toughness, and high hardness.

BACKGROUND

Alloy 9310 has been used for critical aircraft engine gears for over fifty years with incremental changes. Alloy 9310 is a nickel-chromium-molybdenum case-hardening steel with high tensile strength and high fracture toughness.

Current demands desire aircraft engine gears to carry more load but remain at the same size. Unfortunately, conventional carburized gear steels are reaching their upper strength limits for load bearing capacity. In absence of a stronger material, gears will become larger, gear boxes will grow, and aircraft engine designs will change due to lack of a material solution.

Accordingly, those skilled in the art continue with research and development in the field of steel alloys suitable for critical aircraft engine components requiring high tensile strength, high fracture toughness, and high hardness.

SUMMARY

In one embodiment, a steel alloy includes, by weight percent: Ni: 18 to 19%; Co: 11.5 to 12.5%; Mo: 4.6 to 5.2%; Ti: 1.3 to 1.6%; Al: 0.05 to 0.15%; Nb: 0.15 to 0.30%; B: 0.003 to 0.020%; Cr: max 0.25%; Mn: max 0.1%; Si: max 0.1%; C: max 0.03%; P: max 0.005%; and S: max 0.002%, the balance being iron plus incidental impurities.

In another embodiment, a method for heat treating a steel alloy component includes solution annealing the component formed from the steel alloy and age hardening the solution heat treated steel alloy component. The steel alloy includes, by weight percent: Ni: 18 to 19%; Co: 11.5 to 12.5%; Mo: 4.6 to 5.2%; Ti: 1.3 to 1.6%; Al: 0.05 to 0.15%; Nb: 0.15 to 0.30%; B: 0.003 to 0.020%; Cr: max 0.25%; Mn: max 0.1%; Si: max 0.1%; C: max 0.03%; P: max 0.005%; and S: max 0.002%, the balance being iron plus incidental impurities.

Other embodiments of the disclosed steel alloy and associated method for heat treating steel alloy components will become apparent from the following detailed description, the accompanying drawings and the appended claims.

DETAILED DESCRIPTION

Figure 1:
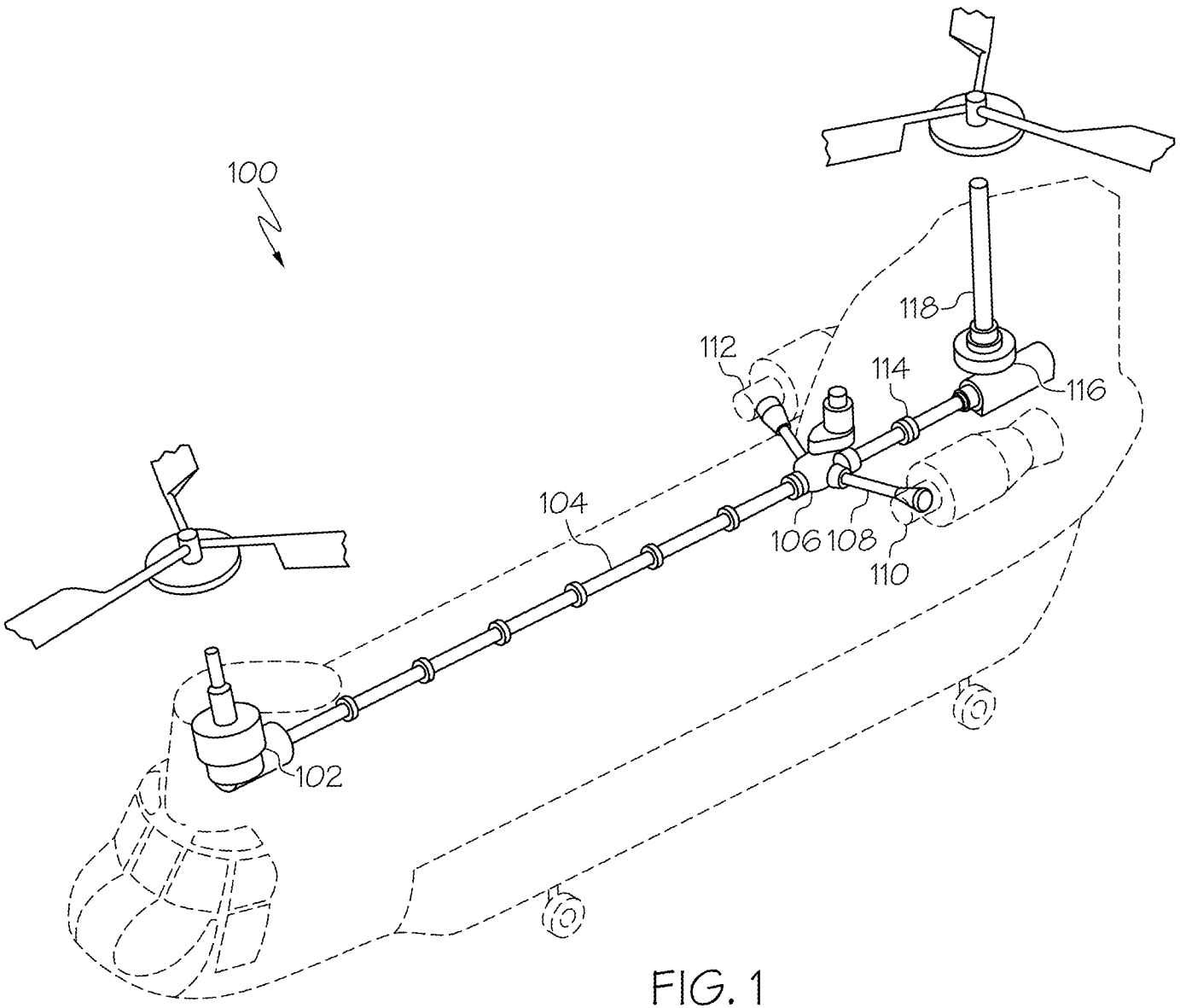
FIG. 1 is a schematic representation of the main systems of an exemplary helicopter drive system.

Maraging 350 is a nickel-cobalt-molybdenum-titanium steel alloy that is precipitation-hardenable to a higher tensile strength than alloy 9310. However, Maraging 350 suffers from low fracture toughness. The present description provides a steel alloy composition that is an improvement of Maraging 350 and provides for a method for heat treating the steel alloy composition.

According to the present description, a steel alloy comprises, by weight percent: nickel (Ni): 18 to 19%; cobalt (Co): 11.5 to 12.5%; molybdenum (Mo): 4.6 to 5.2%; titanium (Ti): 1.3 to 1.6%; aluminum (Al): 0.05 to 0.15%; niobium (Nb): 0.15 to 0.30%; boron (B): 0.003 to 0.020%; chromium (Cr): max 0.25%; manganese (Mn): max 0.1%; silicon (Si): max 0.1%; carbon (C): max 0.03%; phosphorus (P): max 0.005%; and sulfur (S): max 0.002%, the balance being iron plus incidental impurities.

Thus, the steel alloy of the present description is modified relative to standard Maraging 350 by addition of 0.15 to 0.30 weight percent niobium and 0.003 to 0.020 weight percent boron. Without being limited to any particular theory, it is believed that the addition of 0.15 to 0.30 weight percent niobium increases hardness, while the addition of 0.003 to 0.020 weight percent boron increases fracture toughness due to grain boundary cohesion.

In a specific expression, the Nb content of the broadly-defined steel alloy is in a range of 0.15 to 0.20 weight percent. In another specific expression, the Nb content of the broadly-defined steel alloy is in a range of 0.20 to 0.25 weight percent. In yet another specific expression, the Nb content of the broadly-defined steel alloy is in a range of 0.25 to 0.30 weight percent.

In a specific expression, the B content of the steel alloy is in a range of 0.003 to 0.005 weight percent. In another specific expression, the B content of the broadly-defined steel alloy is in a range of 0.005 to 0.010 weight percent. In yet another specific expression, the B content of the broadly-defined steel alloy is in a range of 0.010 to 0.015 weight percent. In yet another specific expression, the B content of the broadly-defined steel alloy is in a range of 0.015 to 0.020 weight percent.

Additionally, it is conceived that each of the broadly-defined narrower Nb content ranges is combined with each of the broadly-defined narrower B content ranges. Thus, in first specific expression, the Nb content of the broadly-defined steel alloy is in a range of 0.15 to 0.20 weight percent and the B content is in a range of 0.003 to 0.005 weight percent. In a second specific expression, the Nb content of the broadly-defined steel alloy is in a range of 0.15 to 0.20 weight percent and the B content is in a range of 0.005 to 0.010 weight percent. In a third specific expression, the Nb content of the broadly-defined steel alloy is in a range of 0.15 to 0.20 weight percent and the B content is in a range of 0.010 to 0.015 weight percent. In a fourth specific expression, the Nb content of the broadly-defined steel alloy is in a range of 0.15 to 0.20 weight percent and the B content is in a range of 0.015 to 0.020 weight percent. In a fifth specific expression, the Nb content of the broadly-defined steel alloy is in a range of 0.20 to 0.25 weight percent and the B content is in a range of 0.003 to 0.005 weight percent. In a sixth specific expression, the Nb content of the broadly-defined steel alloy is in a range of 0.20 to 0.25 weight percent and the B content is in a range of 0.005 to 0.010 weight percent. In a seventh specific expression, the Nb content of the broadly-defined steel alloy is in a range of 0.20 to 0.25 weight percent and the B content is in a range of 0.010 to 0.015 weight percent. In an eighth specific expression, the Nb content of the broadly-defined steel alloy is in a range of 0.20 to 0.25 weight percent and the B content is in a range of 0.015 to 0.020 weight percent. In a ninth specific expression, the Nb content of the broadly-defined steel alloy is in a range of 0.25 to 0.30 weight percent and the B content is in a range of 0.003 to 0.005 weight percent. In a tenth specific expression, the Nb content of the broadly-defined steel alloy is in a range of 0.25 to 0.30 weight percent and the B content is in a range of 0.005 to 0.010 weight percent. In an eleventh specific expression, the Nb content of the broadly-defined steel alloy is in a range of 0.25 to 0.30 weight percent and the B content is in a range of 0.010 to 0.015 weight percent. In a twelfth specific expression, the Nb content of the broadly-defined steel alloy is in a range of 0.25 to 0.30 weight percent and the B content is in a range of 0.015 to 0.020 weight percent.

Common incidental impurities include, for example, zirconium and calcium. In an aspect, the zirconium is controlled to a maximum of 0.020 weight percent. In another aspect, the calcium is controlled to maximum of 0.05 weight percent.

The steel alloy is heat treatable to provide high tensile strength, high fracture toughness, and high hardness desired for critical aircraft engine components, such as shafts and gears for a helicopter drive system.

In an aspect, the steel alloy, after heat treatment, has an ultimate tensile strength of greater than 190 ksi, a $K_{1C}$ fracture toughness of greater than 70 ksi-in$^{1/2}$, and a hardness of greater than 56 HRC.

The ultimate tensile strength of the steel alloy may be varied by varying a heat treatment of the steel alloy. By providing a high ultimate tensile strength, the steel alloy of the present description satisfies current demands for providing components with increased load bearing capacity without increasing a size of the components. Accordingly, in an aspect, the steel alloy, after heat treatment, has an ultimate tensile strength of greater than 210 ksi. In another aspect, the steel alloy, after heat treatment, has an ultimate tensile strength of greater than 230 ksi. In yet another aspect, the steel alloy, after heat treatment, has an ultimate tensile strength of greater than 250 ksi. In yet another aspect, the steel alloy, after heat treatment, has an ultimate tensile strength of greater than 270 ksi.

On the other hand, increasing an ultimate tensile strength of the steel alloy too high creates difficulties achieving the desired fracture toughness. Accordingly, in an aspect, an upper limit of the ultimate tensile strength of the steel alloy, after heat treatment, is 320 ksi. In another aspect, an upper limit of the ultimate tensile strength of the steel alloy, after heat treatment, is 300 ksi. In another aspect, an upper limit of the ultimate tensile strength of the steel alloy, after heat treatment, is 290 ksi.

The fracture toughness of the steel alloy may be varied by varying a heat treatment of the steel alloy. For example, a fracture toughness of the steel alloy is increased by aging for a higher temperature and longer period of time. By providing a high fracture toughness, the steel alloy has increased resistance to brittle fracture. Accordingly, in an aspect, the steel alloy, after heat treatment, has a $K_{1C}$ fracture toughness of greater than 75 ksi-in$^{1/2}$. In another aspect, the steel alloy after heat treatment, has a $K_{1C}$ fracture toughness of greater than 80 ksi-in$^{1/2}$. In yet another aspect, the steel alloy has a $K_{1C}$ fracture toughness of greater than 85 ksi-in$^{1/2}$.

The hardness of the steel alloy is achieved by selecting heat treatment parameters for the alloy. For example, longer age hardening times and lower age hardening temperature yield higher hardness. By achieving the desired hardness by the composition and heat treatment of the alloy, no surface hardening post-treatment is required.

By ensuring a sufficient hardness of the steel alloy, the steel alloy can be provided with sufficient durability suitable for critical aircraft engine components. Accordingly, in an aspect, the steel alloy, after heat treatment, has hardness of greater than 58 HRC. In another aspect, the steel alloy after heat treatment, has a hardness of greater than 60 HRC. In yet another aspect, the steel alloy has a hardness of greater than 62 HRC.

The present description provides for a component formed from the steel alloy as described above. In an example, the component is a component for an aircraft, such as a helicopter. In another example, the component is a component for a drive system, such as a helicopter drive system. In a specific example, the component is a shaft or a gear, such as a spur gear.

Referring to FIG. 1, the component formed from the steel alloy as described above is a component of a helicopter drive system of a helicopter. FIG. 1 is a schematic representation of the main systems of an exemplary helicopter drive system 100.

As shown in FIG. 1, the helicopter drive system 100 includes a forward transmission 102, a forward synchronizing shafting 104 coupled with the forward transmission 102, a combiner transmission 106 coupled with the forward synchronizing shafting 104, two cross shafts 108 coupled with the combiner transmission 106, a left engine transmission 110 coupled with one of the cross shafts 108, a right engine transmission 112 coupled with the other of the cross shafts 108, an aft synchronizing shafting 114 coupled with the combiner transmission 106, an aft transmission 116 coupled with the aft synchronizing shafting 114, and an aft vertical shaft 118 coupled with the aft transmission 116. The helicopter drive system 100 directs power from engines to turn the rotors. An engine of the helicopter is connected to the combiner transmission 106. From the combiner transmission 106, the power is directed through the shaftings to the other transmissions.

In an example, the component formed from the steel alloy as described above is a component of forward transmission 102 of helicopter drive system 100. In another example, the component formed from the steel alloy as described above is a component of forward synchronizing shafting 104 of helicopter drive system 100. In another example, the component formed from the steel alloy as described above is a component of combiner transmission 106 of helicopter drive system 100. In another example, the component formed from the steel alloy as described above is a component of cross shaft 108 of helicopter drive system 100. In another example, the component formed from the steel alloy as described above is a component of left engine transmission 110 or right engine transmission 112 of helicopter drive system 100. In another example, the component formed from the steel alloy as described above is a component of aft synchronizing shafting 114 of helicopter drive system 100. In another example, the component formed from the steel alloy as described above is a component of aft transmission 116 of helicopter drive system 100. In another example, the component formed from the steel alloy as described above is a component of aft vertical shaft 118 of helicopter drive system 100.

Figure 2:
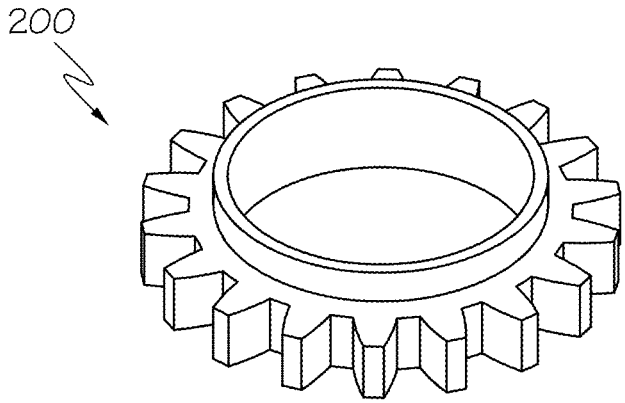
FIG. 2 is a perspective view of a gear, in particular, a spur gear, that may be formed from the steel alloy of the present description.
Figure 3:
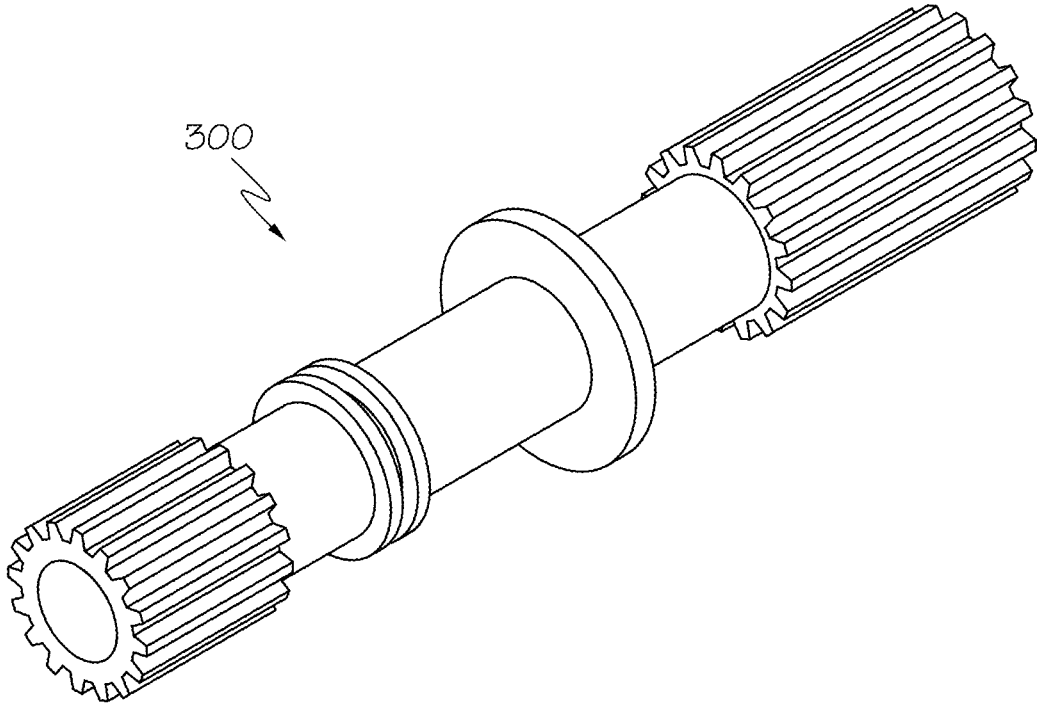
FIG. 3 is a perspective view of a shaft that may be formed from the steel alloy of the present description.

FIGS. 2 and 3 illustrate exemplary components that may be formed from the steel alloy of the present description. FIG. 2 is a perspective view of a gear 200, in particular a spur gear, that may be formed from the steel alloy of the present description. FIG. 3 is a perspective view of a shaft 300 that may be formed from the steel alloy of the present description. However, components that may be formed from the steel alloy of the present description are not limited to shafts and gears. For example, additional components that may benefit from use of the alloy may include fasteners or may include components of an actuator device (e.g. nut and/or screw of a ball screw actuator device).

Figure 4:
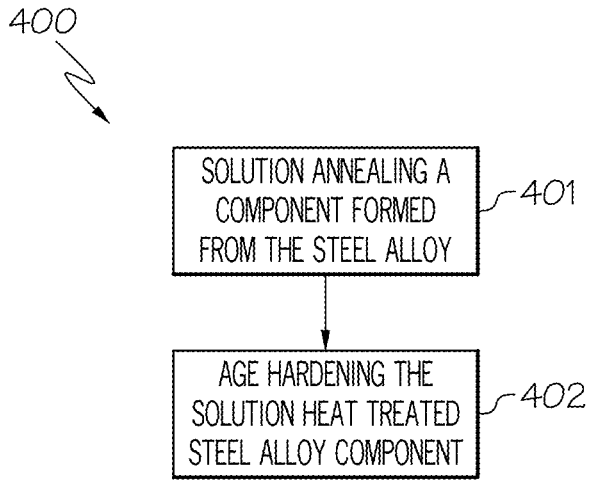
FIG. 4 is a flow diagram of an exemplary method for heat treating a component formed from the steel alloy of the present description.
Figure 5B:
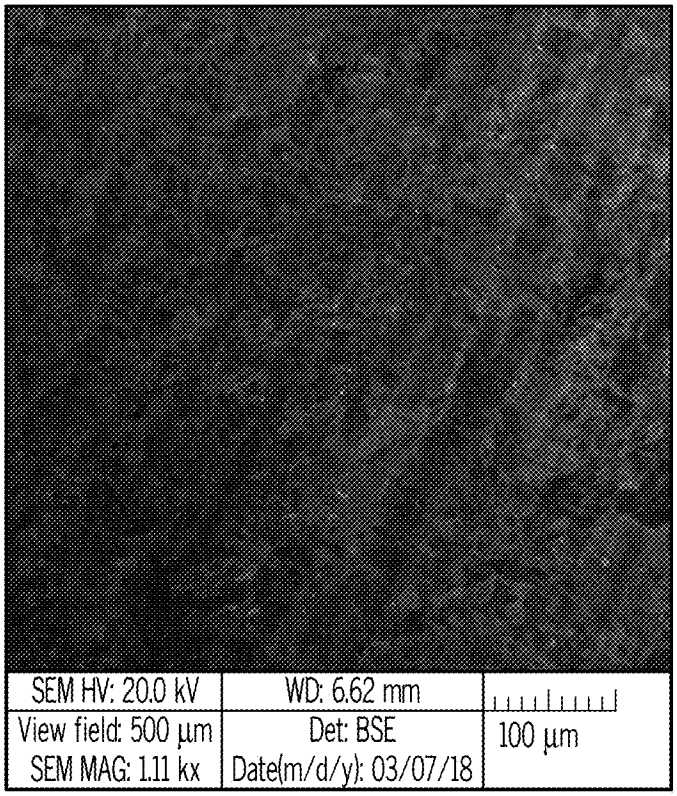
FIGS. 5A, 5B, 5C and 5D are micrographs showing an as-case microstructure of a first exemplary alloy.
Figure 5A:
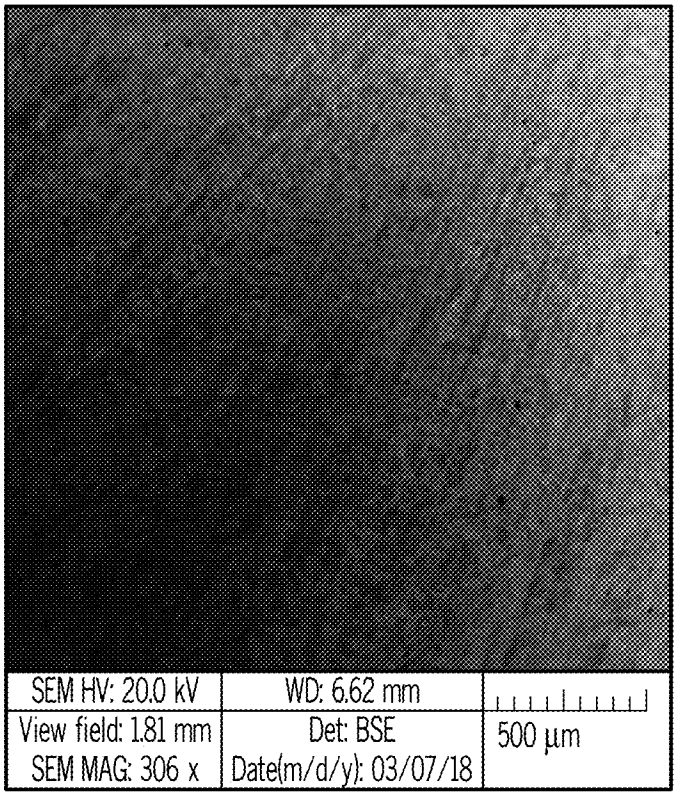
Figure 5C:
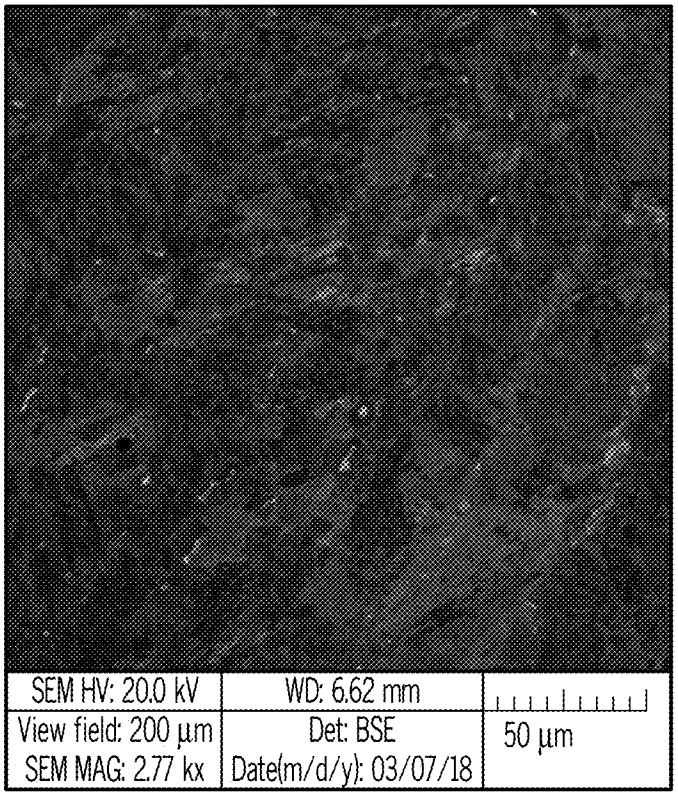
Figure 5D:
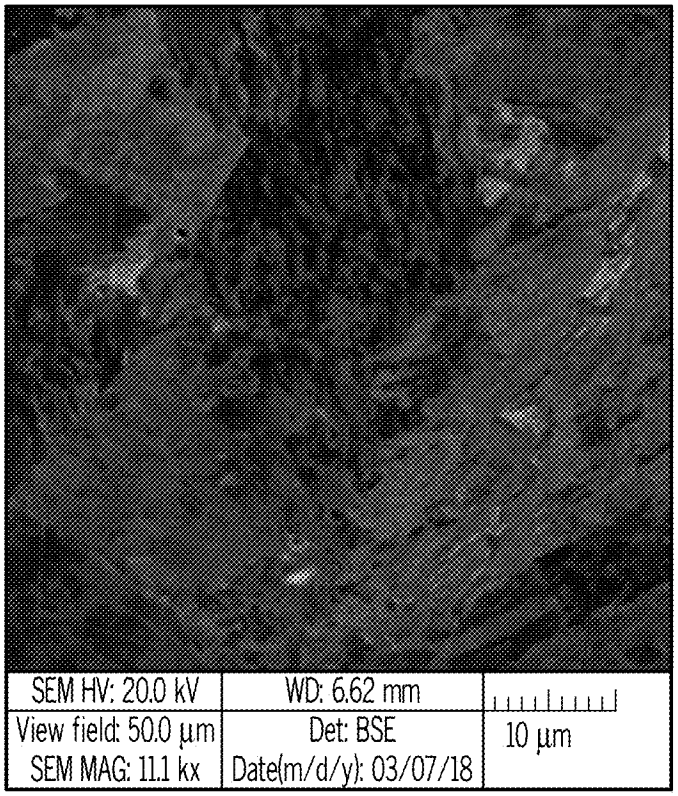
Figure 6B:
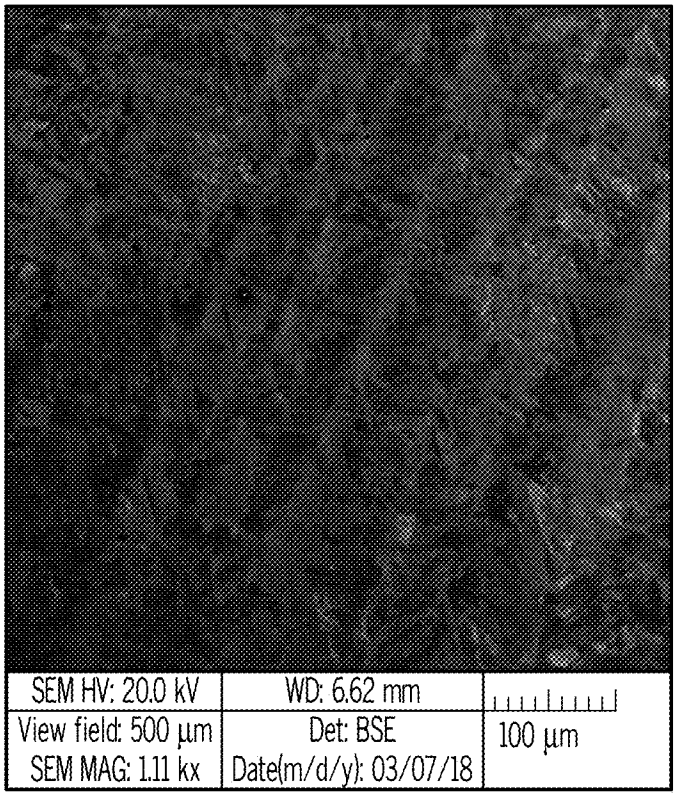
FIGS. 6A, 6B, 6C, and 6D are micrographs showing an as-case microstructure of a second exemplary alloy.
Figure 6A:
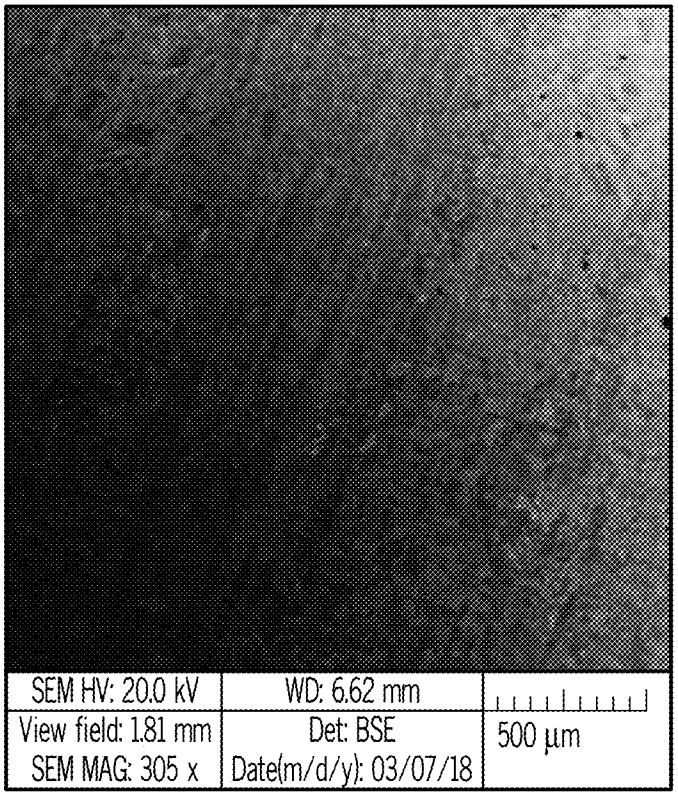
Figure 6C:
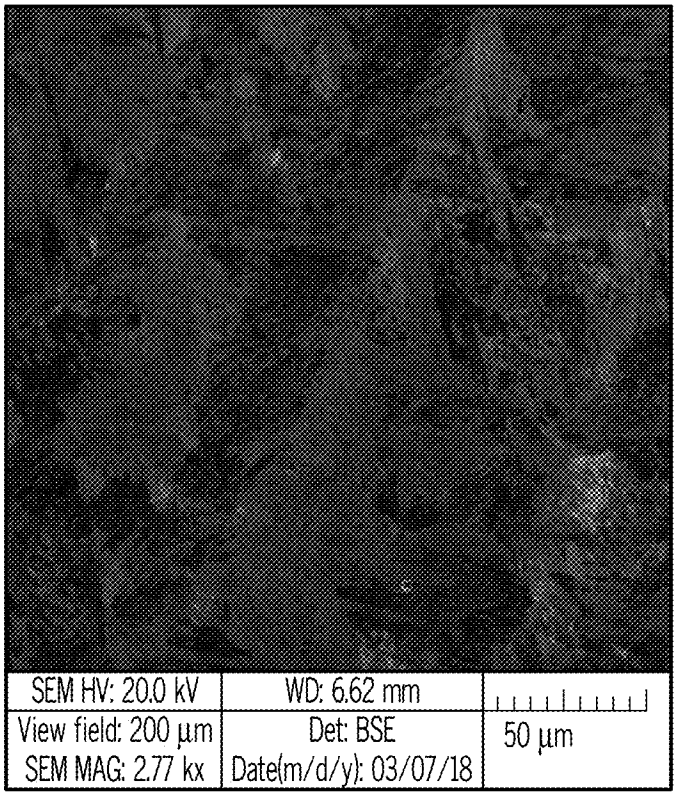
Figure 6D:
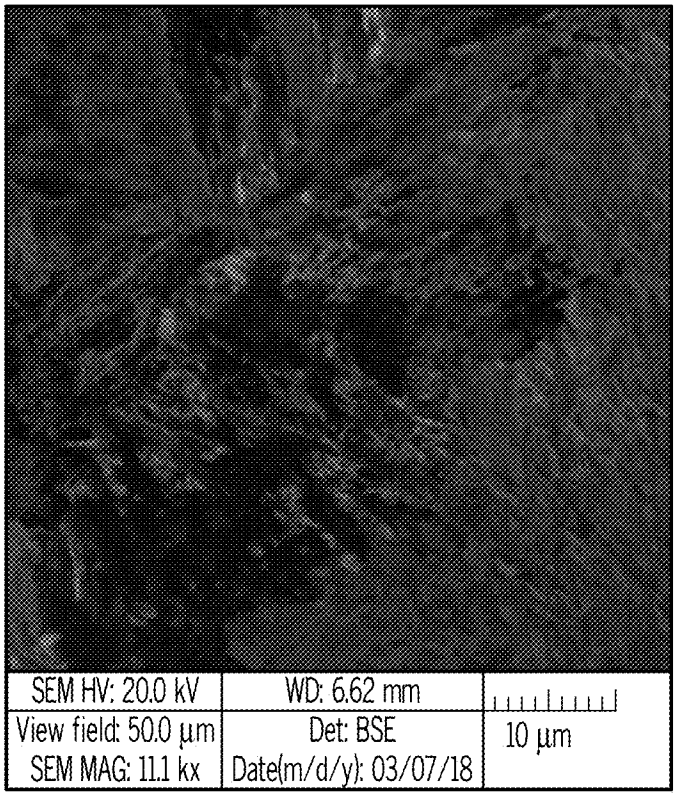

According to the present description, as illustrated in FIG. 4, a method 400 of heat treating a steel alloy component includes, at block 401, solution annealing a component formed from the steel alloy described above and, at block 402, age hardening the solution heat treated steel alloy component. As a result of the solution annealing and age hardening, the steel alloy component can be provided with an ultimate tensile strength of greater than 190 ksi, a fracture toughness of greater than 70 ksi-in$^{1/2}$, and a hardness of greater than 56 HRC.

The step of solution annealing entails heating the alloy above the austenite finish temperature, holding for a sufficient time to place the alloying elements in solid solution, and then cooling the alloy.

If the temperature of the solution annealing is too low, then the alloying elements will not form a sufficient solid solution within a matrix of the alloy. Thus, the minimum temperature of the solution annealing should be sufficient to alloy alloying element to form a solid solution within a matrix of the alloy. In an exemplary aspect, the minimum temperature of the solution annealing is about 815° C.

If the temperature of the solution annealing is too high, then grain growth will occur, which is detrimental to the properties of the alloys. Thus, the maximum temperature of the solution annealing is sufficient to avoid detrimental amounts of grain growth. In an exemplary aspect, the maximum temperature of the solution annealing is about 1150° C.

If the time of the solution annealing is too low, then the alloying elements will not form a sufficient solid solution within a matrix of the alloy. Thus, the minimum time of the solution annealing should be sufficient to alloy alloying element to form a solid solution within a matrix of the alloy. In an exemplary aspect, the minimum time of the solution annealing is about 45 minutes.

If the time of the solution annealing is too high, then grain growth will occur, which is detrimental to the properties of the alloys. Thus, the maximum time of the solution annealing is sufficient to avoid detrimental amounts of grain growth. In an exemplary aspect, the maximum time of the solution annealing is about 90 minutes.

The step of cooling functions to transform the matrix of the alloy from austenite phase to martensite phase. The rate of cooling should be sufficiently slow to avoid cracking and sufficiently fast to avoid grain growth. In an exemplary aspect, the step of cooling the alloy includes air cooling the alloy. During the step of cooling, the alloy is typically cooled to room temperature. If the alloy is insufficiently cooled, then uncooled portions of the alloy may contain retained austenite.

The step of age hardening the solution heat treated steel alloy component causes precipitation and growth of a strengthening phase within the martensite matrix of the alloy.

If the temperature of the age hardening is too low, then the precipitation and growth of the strengthening phase is insufficient, and a high fracture toughness of the alloy may not be achieved. In an exemplary aspect, the minimum temperature of the age hardening is about 480° C.

If the temperature of the age hardening is too high, then the strengthening phase may grow excessively large and a tensile strength of the alloy may not be achieved. In an exemplary aspect, the maximum temperature of the age hardening is about 510° C.

If the time of the age hardening is too low, then the precipitation and growth of the strengthening phase is insufficient, and a high fracture toughness of the alloy may not be achieved. In an exemplary aspect, the minimum time of the age hardening is about 6 hours.

If the time of the age hardening is too high, then the strengthening phase may growth excessively large and a tensile strength of the alloy may not be achieved. In an exemplary aspect, the maximum time of the age hardening is about 12 hours.

As a result of the above-described solution annealing and age hardening, the steel alloy component can be provided with an ultimate tensile strength of greater than 190 ksi, a fracture toughness of greater than 70 ksi-in$^{1/2}$, and a hardness of greater than 56 HRC.

Additional conventional steps of manufacturing the alloy prior to heat treatment may include, for example, casting of the alloy, homogenization of the cast alloy, and forging of the homogenized alloy. Machining of the alloy to final shape may occur after forging and/or between the solution annealing and age hardening steps. Grinding and/or polishing may occur after age hardening.

Alternatively, the steps of manufacturing may include, for example: forming a powder from the alloy, such as by gas or plasma atomization, or forming a wire from the alloy; forming a component from the alloy powder or wire by an additive manufacturing process (or other powder metallurgy processing (e.g., hot isostatic pressing); machining the component to final shape before solution annealing or intermediate to the solution annealing and age hardening steps; and grinding and/or polishing.

EXAMPLES

Two exemplary alloys of the present invention were cast with the compositions listed in Table 1.

TABLE 1

| | Alloy 1 (wt %) | | | Alloy 2 (wt %) | | |
|---|---|---|---|---|---|---|
| Element | Min | Max | Actual | Min | Max | Actual |
| C | — | 0.03 | 0.009 | — | 0.03 | 0.002 |
| Mn | — | 0.1 | 0.01 | — | 0.1 | <0.01 |
| Si | — | 0.1 | <0.01 | — | 0.1 | 0.01 |
| P | — | 0.005 | <0.005 | — | 0.005 | <0.005 |
| S | — | 0.002 | <0.0005 | — | 0.002 | <0.0005 |
| Cr | — | 0.25 | 0.03 | — | 0.25 | 0.02 |
| Ni | 18 | 19 | 18.48 | 18 | 19 | 18.2 |
| Mo | 4.6 | 5.2 | 4.81 | 4.6 | 5.2 | 4.82 |
| Cu | — | — | <0.01 | — | — | <0.01 |
| Co | 11.5 | 12.5 | 11.96 | 11.5 | 12.5 | 12 |
| Al | 0.05 | 0.15 | 0.09 | 0.05 | 0.15 | 0.09 |

TABLE 1-continued

| Element | Alloy 1 (wt %) Min | Max | Actual | Alloy 2 (wt %) Min | Max | Actual |
|---|---|---|---|---|---|---|
| N | — | Report | <0.001 | — | Report | <0.001 |
| Ti | 1.3 | 1.6 | 1.41 | 1.3 | 1.6 | 1.39 |
| B | Aim: 0.003 | | 0.004 | Aim: 0.02 | | 0.013 |
| Nb | Aim: 0.15 | | 0.15 | Aim: 0.3 | | 0.3 |

FIGS. 5A, 5B, 5C and 5D show the as-case microstructures of Alloy 1, with progressively increasing magnifications from FIG. 5A to FIG. 5D. As shown, the as-cast microstructure of Alloy 1 shows large columnar austenite grains.

FIGS. 6A, 6B, 6C and 6D show the as-case microstructures of Alloy 2, with progressively increasing magnifications from FIG. 6A to FIG. 6D. As shown, the as-cast microstructure of Alloy 2 shows large columnar pre-austenite grains.

Rockwell hardness tests were conducted on forged and polished specimens of Alloy 2. Forging was performed using a rotary press operating at about 1,800° F. to achieve a 3-to-1 reduction. At least 13 measurements were taken from arbitrary locations on each specimen. The hardness (HRC) results are summarized in Table 2.

TABLE 2

| Specimen | Anneal Temp. (° C.) | Anneal Time (hr) | Aging Temp. (° C.) | Aging Time (hr) | Average Hardness (HRC) | Standard Deviation |
|---|---|---|---|---|---|---|
| 1 | 1100 | 1 | 480 | 6 | 60.6 | 0.41 |
| 2 | 815 | 1 | 510 | 6 | 63.7 | 0.2 |
| 3 | 815 | 1 | 480 | 6 | 63.6 | 0.12 |
| 4 | 815 | 1 | 480 | 12 | 61.7 | 0.29 |
| 5 | 1100 | 1 | 510 | 6 | 63.5 | 0.59 |
| 6 | 1000 | 1 | 510 | 6 | 63.9 | 0.32 |

The maximum hardness (63.9 HRC) was obtained with solution annealing at 1,000° C. and aging for 6 hours at 510° C. Due to time and budgetary constraints, the Rockwell hardness tests were only performed for Alloy 2, but similar results are expected for Alloy 1.

Tensile testing per ASTM E8 was conducted on forged specimens of Alloy 1 and Alloy 2. Forging was performed using a rotary press operating at about 1,800° F. to achieve a 3-to-1 reduction. The tensile test results are presented in Tables 3 and 4.

TABLE 3

(Specimen Key)

| Specimen | Composition | Anneal Temp. (° C.) | Anneal Time (hr) | Aging Temp. (° C.) | Aging Time (hr) |
|---|---|---|---|---|---|
| 05-1-T2 | Alloy 1 | 850 | 1 | — | — |
| 05-1-T3 | Alloy 1 | 850 | 1 | 500 | 3 |
| 05-1-T5 | Alloy 1 | 850 | 1 | 500 | 3 |
| 05-1-T6 | Alloy 1 | 850 | 1 | 500 | 10 |
| 05-1-T7 | Alloy 1 | 850 | 1 | 500 | 3 |
| 05-1-T9 | Alloy 1 | 850 | 1 | — | — |
| 05-1-T10 | Alloy 1 | 850 | 1 | 500 | 10 |
| 05-1-T11 | Alloy 1 | 850 | 1 | 500 | 3 |
| 05-1-T12 | Alloy 1 | 850 | 1 | — | — |
| 05-2-T1 | Alloy 1 | 850 | 1 | 500 | 10 |
| 05-2-T2 | Alloy 1 | 850 | 1 | 540 | 3 |
| 05-2-T5 | Alloy 1 | 850 | 1 | — | — |

TABLE 3-continued (Specimen Key)

| Specimen | Composition | Anneal Temp. (° C.) | Anneal Time (hr) | Aging Temp. (° C.) | Aging Time (hr) |
|---|---|---|---|---|---|
| 05-2-T7 | Alloy 1 | 850 | 1 | 540 | 3 |
| 05-2-T8 | Alloy 1 | 850 | 1 | 500 | 10 |
| 05-2-T10 | Alloy 1 | 850 | 1 | 540 | 3 |
| 05-2-T11 | Alloy 1 | 850 | 1 | 540 | 3 |
| 06-1-T1 | Alloy 2 | 850 | 1 | 540 | 3 |
| 06-1-T2 | Alloy 2 | 850 | 1 | 500 | 3 |
| 06-1-T3 | Alloy 2 | 850 | 1 | — | — |
| 06-1-T4 | Alloy 2 | 850 | 1 | — | — |
| 06-1-T5 | Alloy 2 | 850 | 1 | 500 | 3 |
| 06-1-T6 | Alloy 2 | 850 | 1 | 500 | 10 |
| 06-1-T8 | Alloy 2 | 850 | 1 | 500 | 10 |
| 06-1-T9 | Alloy 2 | 850 | 1 | — | — |
| 06-1-T10 | Alloy 2 | 850 | 1 | 540 | 3 |
| 06-1-T11 | Alloy 2 | 850 | 1 | 500 | 10 |
| 06-02-T1 | Alloy 2 | 850 | 1 | 500 | 10 |
| 06-02-T2 | Alloy 2 | 850 | 1 | 500 | 3 |
| 06-02-T7 | Alloy 2 | 850 | 1 | — | — |
| 06-02-T8 | Alloy 2 | 850 | 1 | 500 | 3 |
| 06-02-T10 | Alloy 2 | 850 | 1 | 540 | 3 |

TABLE 4

(Test Results)

| Specimen | Initial Diameter (in) | Initial Area (in2) | Ultimate Tensile Strength (ksi) | 0.2% Offset Yield Strength (ksi) | Elongation in 4D (%) | Reduction of Area (%) |
|---|---|---|---|---|---|---|
| 05-1-T2 | 0.249 | 0.0487 | 167 | 113 | 17 | 74 |
| 05-1-T3 | 0.25 | 0.0491 | 348 | 340 | 10 | 53 |
| 05-1-T5 | 0.249 | 0.0487 | 361 | 351 | 4.5 | 21 |
| 05-1-T6 | 0.249 | 0.0487 | 366 | 356 | 4.1 | 15 |
| 05-1-T7 | 0.25 | 0.0491 | 361 | 353 | 3.8 | 23 |
| 05-1-T9 | 0.248 | 0.0483 | 163 | 129 | 16 | 75 |
| 05-1-T10 | 0.248 | 0.0483 | 364 | 356 | 3.7 | 20 |
| 05-1-T11 | 0.249 | 0.0487 | 346 | 334 | 5.5 | 23 |
| 05-1-T12 | 0.25 | 0.0491 | 168 | 119 | 17 | 75 |
| 05-2-T1 | 0.25 | 0.0491 | 365 | 354 | 7.5 | 45 |
| 05-2-T2 | 0.25 | 0.0491 | 359 | 350 | 4.5 | 24 |
| 05-2-T5 | 0.249 | 0.0487 | 174 | 155 | 15 | 74 |
| 05-2-T7 | 0.249 | 0.0487 | 367 | — | 8.5 | 47 |
| 05-2-T8 | 0.25 | 0.0491 | 364 | 357 | 7.5 | 46 |
| 05-2-T10 | 0.249 | 0.0487 | 355 | 348 | 9.5 | 48 |
| 05-2-T11 | 0.248 | 0.0483 | 352 | 343 | 8.5 | 49 |
| 06-1-T1 | 0.25 | 0.0491 | 357 | 353 | 3.4 | 12 |
| 06-1-T2 | 0.249 | 0.0487 | 341 | 331 | 7 | 38 |
| 06-1-T3 | 0.249 | 0.0487 | 170 | 127 | 15 | 66 |
| 06-1-T4 | 0.248 | 0.0483 | 169 | 113 | 15 | 66 |
| 06-1-T5 | 0.25 | 0.0491 | 358 | 351 | 3.8 | 8.5 |
| 06-1-T6 | 0.25 | 0.0491 | 367 | 360 | 3.7 | 18 |
| 06-1-T8 | 0.249 | 0.0487 | 364 | 358 | 3.8 | 10 |
| 06-1-T9 | 0.25 | 0.0491 | 170 | 119 | 15 | 66 |
| 06-1-T10 | 0.25 | 0.0491 | 359 | 354 | 6.5 | 31 |
| 06-1-T11 | 0.25 | 0.0491 | 369 | 364 | 4.1 | 21 |
| 06-02-T1 | 0.249 | 0.0487 | 371 | 364 | 3.9 | 23 |
| 06-02-T2 | 0.25 | 0.0491 | 348 | 338 | 5 | 27 |
| 06-02-T7 | 0.248 | 0.0483 | 166 | 113 | 15 | 67 |
| 06-02-T8 | 0.25 | 0.0491 | 355 | 346 | 4.6 | 23 |
| 06-02-T10 | 0.249 | 0.0487 | 361 | 354 | 7.5 | 37 |

Fracture toughness tests were conducted at room temperature on forged specimens of Alloy 1 and Alloy 2. Forging was performed using a rotary press operating at about 1,800° F. to achieve a 3-to-1 reduction. The fracture toughness results are summarized in Tables 5 and 6A-6C.

TABLE 5

| (Specimen Key) | | | | | |
|---|---|---|---|---|---|
| Specimen | Composition | Anneal Temp. (° C.) | Anneal Time (hr) | Aging Temp. (° C.) | Aging Time (hr) |
| 05-01-L-T1 | Alloy 1 | 850 | 1 | — | — |
| 05-01-L-T2 | Alloy 1 | 850 | 1 | — | — |
| 05-01-L-T16 | Alloy 1 | 850 | 1 | — | — |
| 05-02-L-T1 | Alloy 1 | 850 | 1 | — | — |
| 05-02-L-T3 | Alloy 1 | 850 | 1 | — | — |
| 05-02-L-T14 | Alloy 1 | 1000 | 1 | 540 | 3 |
| 06-01-L-T2 | Alloy 2 | 850 | 1 | — | — |
| 06-01-L-T15 | Alloy 2 | 850 | 1 | — | — |
| 06-01-L-T16 | Alloy 2 | 850 | 1 | — | — |
| 06-02-L-T1 | Alloy 2 | 850 | 1 | — | — |
| 06-02-L-T3 | Alloy 2 | 850 | 1 | — | — |
| 06-02-L-T13 | Alloy 2 | 850 | 1 | — | — |

TABLE 6A

| | | | Final 2.5% Precrack Data | | |
|---|---|---|---|---|---|
| Specimen | Specimen Thickness "B" in. | Specimen Width "W" in. | Maximum Stress Intensity ksi-in.$^{1/2}$ | Stress Intensity range ksi-in.$^{1/2}$ | Precrack Cycles N |
| 05-01-L-T1 | 0.376 | 0.750 | 22.6 | 20.3 | 4572 |
| 05-01-L-T2 | 0.377 | 0.750 | 22.4 | 20.2 | 3965 |
| 05-01-L-T16 | 0.373 | 0.750 | 22.7 | 20.4 | 4272 |
| 05-02-L-T1 | 0.376 | 0.750 | 20.7 | 18.6 | 3661 |
| 05-02-L-T3 | 0.376 | 0.750 | 22.9 | 20.6 | 3778 |
| 05-02-L-T14 | 0.376 | 0.750 | 22.3 | 20.1 | 4375 |
| 06-01-L-T2 | 0.374 | 0.750 | 22.2 | 20.0 | 5292 |
| 06-01-L-T15 | 0.374 | 0.751 | 21.9 | 19.7 | 5232 |
| 06-01-L-T16 | 0.373 | 0.751 | 22.9 | 20.6 | 4480 |
| 06-02-L-T1 | 0.376 | 0.751 | 21.8 | 19.6 | 3928 |
| 06-02-L-T3 | 0.376 | 0.751 | 22.8 | 20.5 | 3793 |
| 06-02-L-T13 | 0.376 | 0.751 | 22.8 | 20.5 | 5232 |

TABLE 6B

| | Crack Measurements (a) | | | | | |
|---|---|---|---|---|---|---|
| Specimen | Average in. | Surface 1 in. | ¼ Thickness in. | ½ Thickness in. | ¾ Thickness in. | Surface 2 in. |
| 05-01-L-T1 | 0.387 | 0.357 | 0.388 | 0.395 | 0.379 | 0.340 |
| 05-01-L-T2 | 0.389 | 0.380 | 0.398 | 0.397 | 0.372 | 0.347 |
| 05-01-L-T16 | 0.392 | 0.367 | 0.395 | 0.396 | 0.384 | 0.352 |
| 05-02-L-T1 | 0.364 | 0.396 | 0.404 | 0.374 | 0.313 | 0.292 |
| 05-02-L-T3 | 0.394 | 0.358 | 0.389 | 0.404 | 0.389 | 0.356 |
| 05-02-L-T14 | 0.390 | 0.344 | 0.374 | 0.394 | 0.402 | 0.387 |
| 06-01-L-T2 | 0.377 | 0.357 | 0.379 | 0.383 | 0.369 | 0.339 |
| 06-01-L-T15 | 0.354 | 0.325 | 0.345 | 0.358 | 0.360 | 0.347 |
| 06-01-L-T16 | 0.394 | 0.379 | 0.405 | 0.402 | 0.376 | 0.346 |
| 06-02-L-T1 | 0.382 | 0.365 | 0.384 | 0.384 | 0.379 | 0.364 |
| 06-02-L-T3 | 0.393 | 0.451 | 0.436 | 0.397 | 0.346 | 0.280 |
| 06-02-L-T13 | 0.384 | 0.358 | 0.393 | 0.387 | 0.372 | 0.355 |

TABLE 6C

| Specimen | Material Yield Strength ksi | $K_Q$ ksi-in$^{1/2}$ | $K_Q$ = KIC? | Invalid According to Test Method E399 Section: | $P_{MAX}/P_Q$ |
|---|---|---|---|---|---|
| 05-01-L-T1 | 129.0 | 131.3 | NO | 9.1.3, 9.1.4 | 1.14 |
| 05-01-L-T2 | 129.0 | 120.5 | NO | 9.1.3, 9.1.4 | 1.26 |
| 05-01-L-T16 | 129.0 | 81.7 | NO | 9.1.3, 9.1.4 | 1.84 |

TABLE 6C-continued

| Specimen | Material Yield Strength ksi | $K_Q$ ksi-in$^{1/2}$ | $K_Q$ = KIC? | Invalid According to Test Method E399 Section: | $P_{MAX}/P_Q$ |
|---|---|---|---|---|---|
| 05-02-L-T1 | 129.0 | 76.9 | NO | 7.3.2.2, 8.2.4, 8.2.3, 9.1.3, 9.1.4 | 2.02 |
| 05-02-L-T3 | 129.0 | 123.6 | NO | 9.1.3, 9.1.4 | 1.23 |
| 05-02-L-T14 | 325.0 | 76.4 | NO | 8.2.3, 9.1.3 | 1.92 |
| 06-01-L-T2 | 129.0 | 84.1 | NO | 9.1.3, 9.1.4 | 1.48 |
| 06-01-L-T15 | 129.0 | 119.4 | NO | 9.1.4 | 1.04 |
| 06-01-L-T16 | 129.0 | 90.7 | NO | 9.1.3, 9.1.4 | 1.36 |
| 06-02-L-T1 | 129.0 | 79.0 | NO | 9.1.3, 9.1.4 | 1.47 |
| 06-02-L-T3 | 129.0 | 24.2 | NO | 7.3.2.2, 8.2.4, 8.2.3, A8.3.3 | 1.02 |
| 06-02-L-T13 | 129.0 | 77.8 | NO | 9.1.3, 9.1.4 | 1.65 |

Tables 5 and 6A-6C show that $K_{1C}$ fracture toughness could not be obtained for Alloy 1 and Alloy 2, as Alloy 1 and Alloy 2 exceeded expectations in their ability to blunt cracks. Instead, the $K_Q$ scale was used. Alloy 1 has an average $K_Q$ fracture toughness of 79.2 ksi-in$^{1/2}$. Alloy 2 has an average $K_Q$ fracture toughness of 101.7 ksi-in$^{1/2}$.

Figure 7:
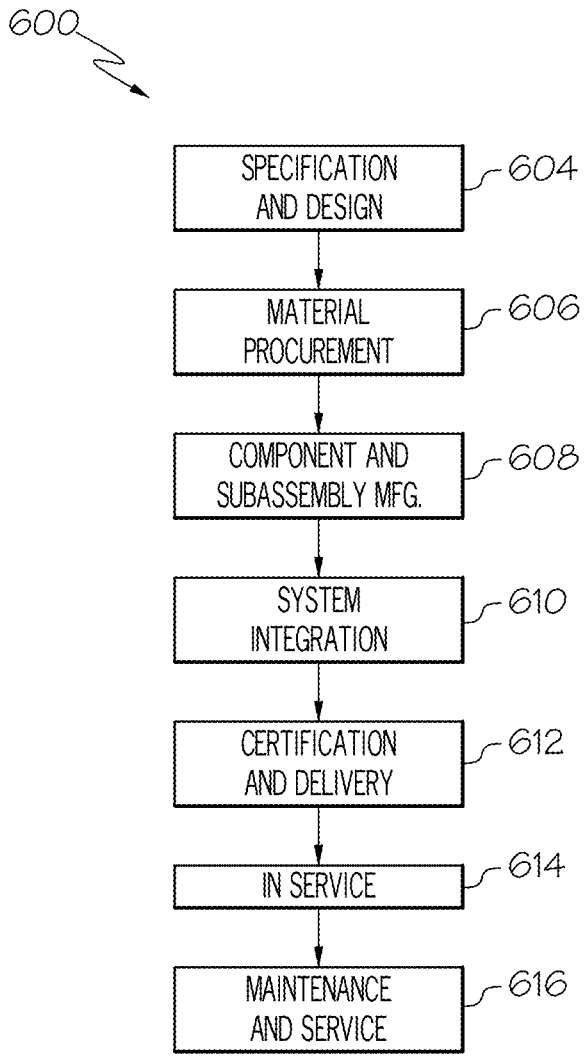
FIG. 7 is a flow diagram of an aircraft manufacturing and service methodology.
Figure 8:
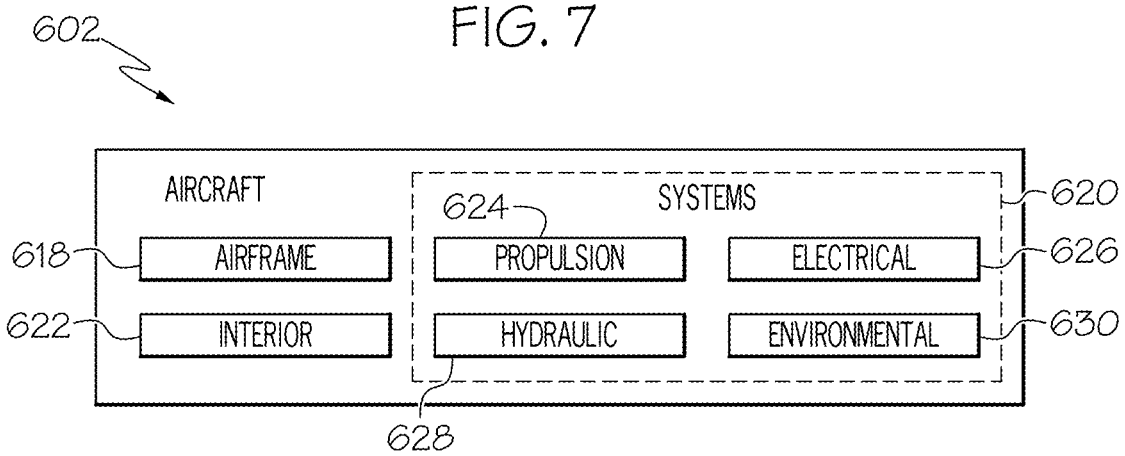
FIG. 8 is a block diagram of an aircraft.

Examples of the present disclosure may be described in the context of an aircraft manufacturing and service method 600, as shown in FIG. 7, and an aircraft 602, as shown in FIG. 8. During pre-production, the aircraft manufacturing and service method 600 may include specification and design 604 of the aircraft 602 and material procurement 606. During production, component/subassembly manufacturing 608 and system integration 610 of the aircraft 602 takes place. Thereafter, the aircraft 602 may go through certification and delivery 612 in order to be placed in service 614. While in service by a customer, the aircraft 602 is scheduled for routine maintenance and service 616, which may also include modification, reconfiguration, refurbishment and the like.

Each of the processes of method 600 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

The alloys and methods of heat treatment may be employed during any one or more of the stages of the aircraft manufacturing and service method 600, including specification and design 604 of the aircraft 602, material procurement 606, component/subassembly manufacturing 608, system integration 610, certification and delivery 612, placing the aircraft in service 614, and routine maintenance and service 616.

As shown in FIG. 8, the aircraft 602 produced by example method 600 may include an airframe 618 with a plurality of systems 620 and an interior 622. Examples of the plurality of systems 620 may include one or more of a propulsion system 624, an electrical system 626, a hydraulic system 628, and an environmental system 630. Any number of other systems may be included. The alloys and methods of heat treatment of the present disclosure may be employed for any of the systems of the aircraft 602.

Although various embodiments of the disclosed steel alloy and method for heat treating steel alloy components have been shown and described, modifications may occur to those skilled in the art upon reading the specification. The present application includes such modifications and is limited only by the scope of the claims.

What is claimed is:

1. A steel alloy comprising, by weight percent:

Ni: 18 to 19%;
Co: 11.5 to 12.5%;
Mo: 4.6 to 5.2%;
Ti: 1.3 to 1.6%;
Al: 0.05 to 0.15%;
Nb: 0.15 to 0.30%;
B: 0.003 to 0.020%;
Cr: max 0.25%;
Mn: max 0.1%;
Si: max 0.1%;
C: max 0.03%;
P: max 0.005%; and
S: max 0.002%, the balance being iron plus incidental impurities, wherein the steel alloy has a hardness of at least about 56 HRC, and wherein the steel alloy has an ultimate tensile strength of at least about 190 ksi.

2. The steel alloy of claim 1 wherein the Nb content is in a range of 0.15 to 0.20 weight percent.

3. The steel alloy of claim 1 wherein the Nb content is in a range of 0.20 to 0.25 weight percent.

4. The steel alloy of claim 1 wherein the Nb content is in a range of 0.25 to 0.30 weight percent.

5. The steel alloy of claim 1 wherein the B content is in a range of 0.003 to 0.005 weight percent.

6. The steel alloy of claim 1 wherein the B content is in a range of 0.005 to 0.010 weight percent.

7. The steel alloy of claim 1 wherein the B content is in a range of 0.010 to 0.015 weight percent.

8. The steel alloy of claim 1 wherein the B content is in a range of 0.015 to 0.020 weight percent.

9. The steel alloy of claim 1 having an ultimate tensile strength of 210 ksi.

10. The steel alloy of claim 1 having a $K_Q$ fracture toughness of at least about 70 ksi-in$^{1/2}$.

11. The steel alloy of claim 1 having a hardness of greater than 60 HRC.

12. A powder formed from the steel alloy of claim 1.

13. A wire formed from the steel alloy of claim 1.

14. An aircraft component formed from the steel alloy of claim 1.

15. A helicopter component formed from the steel alloy of claim 1.

16. A drive system component formed from the steel alloy of claim 1.

17. A method for heat treating a steel alloy component, the method comprising:

solution annealing a component formed from the steel alloy of claim 1; and age hardening the solution heat treated steel alloy component.

18. The method of claim 17 wherein the solution annealing includes heating the component at a temperature of between about 815° C. and about 1150° C.

19. The method of claim 18 wherein the solution annealing includes heating the component for a time of about 45 minutes to about 90 minutes.

20. An age hardened steel alloy component formed by the method of claim 17, wherein the age hardened steel alloy component has an ultimate tensile strength of greater than 210 ksi, a fracture toughness of greater than 70 ksi-in$^{1/2}$, and a hardness of greater than 58 HRC.

21. The steel alloy of claim 1 wherein the B content is in a range of 0.005 to 0.020 weight percent.

22. A shaft formed from the steel alloy of claim 1.

23. A gear formed from the steel alloy of claim 1.

* * * * *